United States Patent [19]

Weber

[11] 4,343,354

[45] Aug. 10, 1982

[54] STATIC CYLINDRICAL MONOLITHIC STRUCTURE HAVING A LARGE AREA OF CONTACT

[75] Inventor: Jean Weber, Tarbes, France

[73] Assignee: Ceraver, Paris, France

[21] Appl. No.: 190,769

[22] Filed: Sep. 25, 1980

[30] Foreign Application Priority Data

Sep. 25, 1979 [FR] France ..... 79 23767

[51] Int. Cl.[3] ..... F28D 17/04

[52] U.S. Cl. ..... 165/165; 165/10

[58] Field of Search ..... 165/165, 10, 10 R, 10 A

[56] References Cited

U.S. PATENT DOCUMENTS

| | | | |
|---|---|---|---|
| 2,706,109 | 4/1955 | Odman et al. | 165/10 |
| 3,548,932 | 12/1970 | Menkus | 165/165 |
| 4,041,591 | 8/1977 | Noll et al. | 165/165 X |
| 4,044,825 | 8/1977 | Gugenberger et al. | 165/165 |
| 4,126,178 | 11/1978 | Kelm | 165/165 |

FOREIGN PATENT DOCUMENTS

| | | | |
|---|---|---|---|
| 983474 | 2/1976 | Canada . | |
| 25980 | 4/1981 | European Pat. Off. | 165/165 |
| 2721321 | 2/1978 | Fed. Rep. of Germany | 165/165 |
| 985078 | 7/1951 | France | 165/165 |
| 2381265 | 9/1978 | France . | |
| 135549 | 11/1919 | United Kingdom . | |
| 1371808 | 10/1974 | United Kingdom | 165/10 |
| 357446 | 12/1972 | U.S.S.R. | 165/165 |

*Primary Examiner*—Sheldon J. Richter

*Attorney, Agent, or Firm*—Sughrue, Mion, Zinn, Macpeak & Seas

[57] ABSTRACT

The invention relates to a static cylindrical monolithic cellular structure with a large contact area, said structure being used in particular for a static heat exchanger and including a plurality of parallel ducts. Its general organization is essentially cylindrical, and the ducts are defined by radial walls (10) and circumferential walls (11). Said ducts form groups for conveying different fluids with the groups being in an essentially radial configuration, i.e, with groups for conveying different fluids at least some of the radial type walls constituting the boundaries between different fluid flows. Application in particular to static exchangers and to filters.

19 Claims, 13 Drawing Figures

STATIC CYLINDRICAL MONOLITHIC STRUCTURE HAVING A LARGE AREA OF CONTACT

FIELD OF THE INVENTION

The present invention relates to a static cylindrical monolithic cellular structure having a large area of contact, and comprising a plurality of parallel ducts separated by radial type walls and by circular type walls. In use the ducts are arranged in at least two groups, with each group conveying a flow of fluid particular to the group. Such a structure is particularly applicable to heat exchangers, but also has other applications, e.g. operations that require catalytic action on gases, and operations in which material is exchanged by diffusion through the walls.

BACKGROUND OF THE INVENTION

British Pat. No. 135 549 discloses a cellular structure of this nature for heat exchange in a gas works. The various gases flow through concentric zones such that the heat exchange area between the gases is fairly small. Heat exchange takes place under rather unfavourable conditions and there remain high temperature differences between the inlet hot gas and the outlet heated gas and between the inlet cold gas and the outlet cooled gas.

Preferred embodiments of the present invention mitigate this drawback by providing an easily fabricated cylindrical cellular structure having a large area of contact per unit volume. Ease of fabrication is particularly desirable when the structure is made of ceramics material such as is required for operation at high temperatures, say in the range 1200° C. to 1400° C.

SUMMARY OF THE INVENTION

The present invention provides a static, cylindrical monolithic, cellular structure having a large area of contact and comprising a plurality of parallel ducts separated by radial type walls and by circular type walls and in which the ducts are arranged in at least two groups of ducts with each group being capable of conveying a fluid flow particular to the group, and wherein the groups of ducts are disposed in a generally radial configuration with at least some of the radial type walls constituting group boundaries.

The structure in accordance with the invention may also have at least one of the following features.

The structure is produced in the shape of a hollow cylinder whose annular cross-section is constituted by sets of parallel ducts and whose central passage is a duct which can bring in or remove a flux. The duct is closed in the neighbourhood of one of its ends by a sealed plug. Advantageously, the structure has an end piece at each end, said end piece making it possible to close the annular end surface while allowing free access to the central duct.

A group of ducts communicates with the central duct. The end piece simultaneously closes said ducts. The other group of ducts have lateral inlet and outlet orifices for the associated flux. Then, the orifices open directly against the planes of the annular end surfaces or else are set at a distance from said surfaces with a view to providing greater rigidity.

The partitioning between the two groups of ducts is such that the flux removed through the associated lateral orifices is a filtered part of the flux brought in via the central duct after passing through said partitioning.

Each annular end surface has a selective radial closing means so that one of the two fluxes is brought in and removed via said annular surfaces while the group of ducts associated with the other flux has lateral inlet and outlet orifices for said flux. In which case, selective closing can advantageously be provided by a set of radiating annular sectors and then, in their large zones, the annular sectors each have a portion which is not cut out and opens into other ducts concerned by the flux brought in and removed via the annular end surfaces and at each end. It has an end piece whose circular rim presses against the periphery of each annular end surface and whose surface defines an inner chamber which opens towards the outside via a narrower orifice.

The radial walls of the parallel ducts are rectilinear and form radial planes or planes which are parallel in pairs or are corrugated.

The circular walls of the parallel ducts form cylinders which are coaxial with said structure or rectilinear between two adjacent radial type walls and define contours illustrated by dashed lines. These circular type walls can be disposed in a configuration which is staggered between each pair of radial type walls, and, in the case of corrugated radial type walls, can be joined to the walls at the crests of the corrugations.

BRIEF DESCRIPTIONS OF THE DRAWINGS

Figure 7:
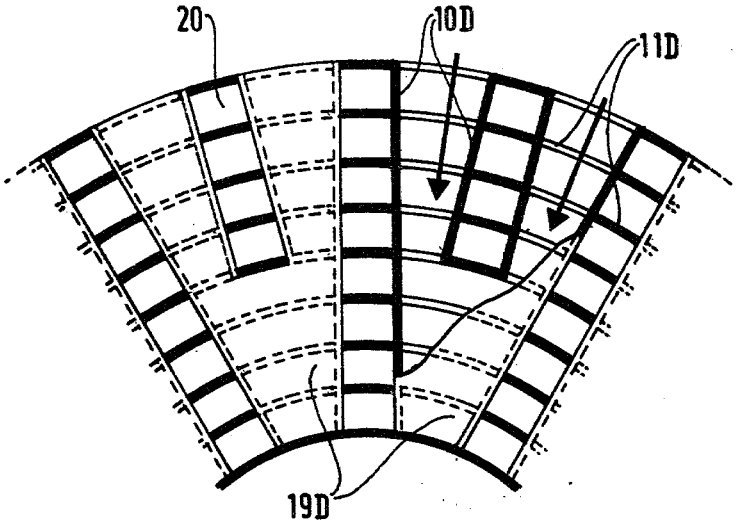
Figure 8:
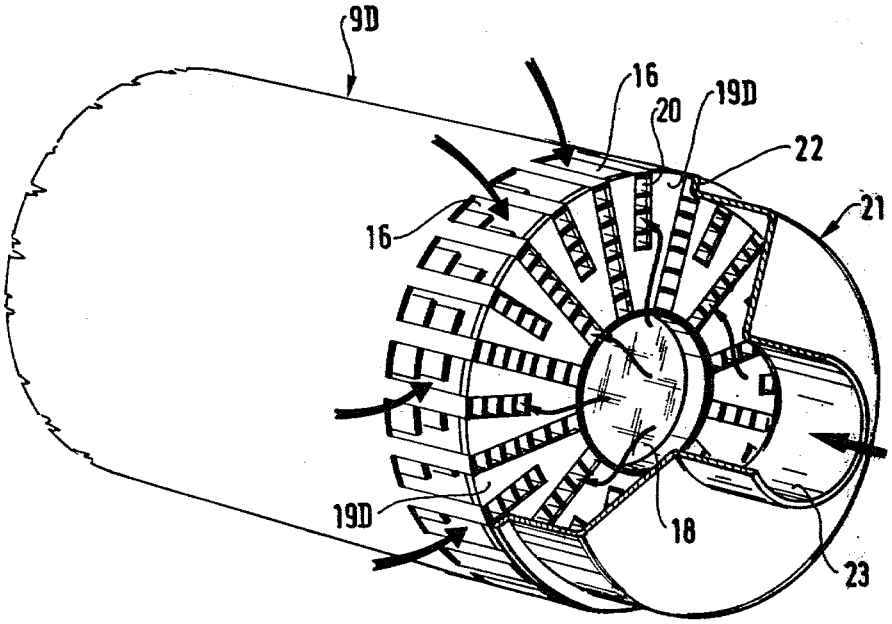

FIGS. 7 and 8 respectively a partially cutaway view and a perspective view of a variant of the structure in which variant, one of the fluxes is brought in and removed via the end surfaces.

Figure 9:
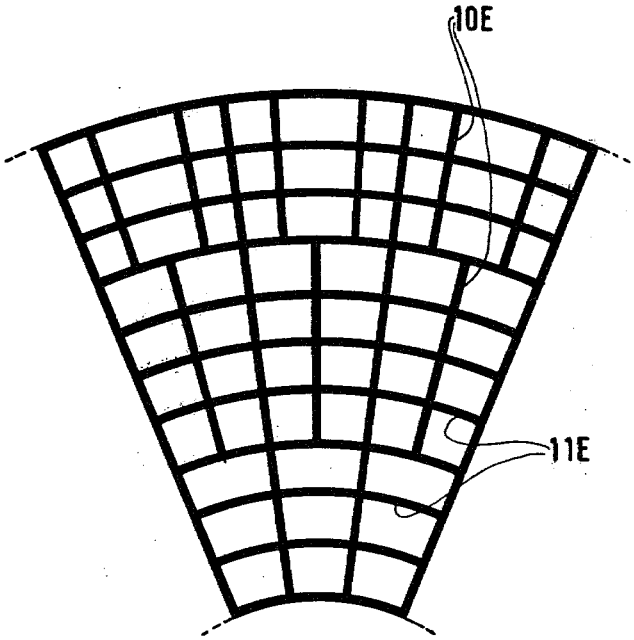

FIG. 9 is a sectional view which illustrates a mesh configuration with cells which are almost square, said mesh configuration being particularly suitable for a structure through which only one flux passes with a view to a great accumulation of thermal energy.

DETAILED DESCRIPTION

Figure 1:
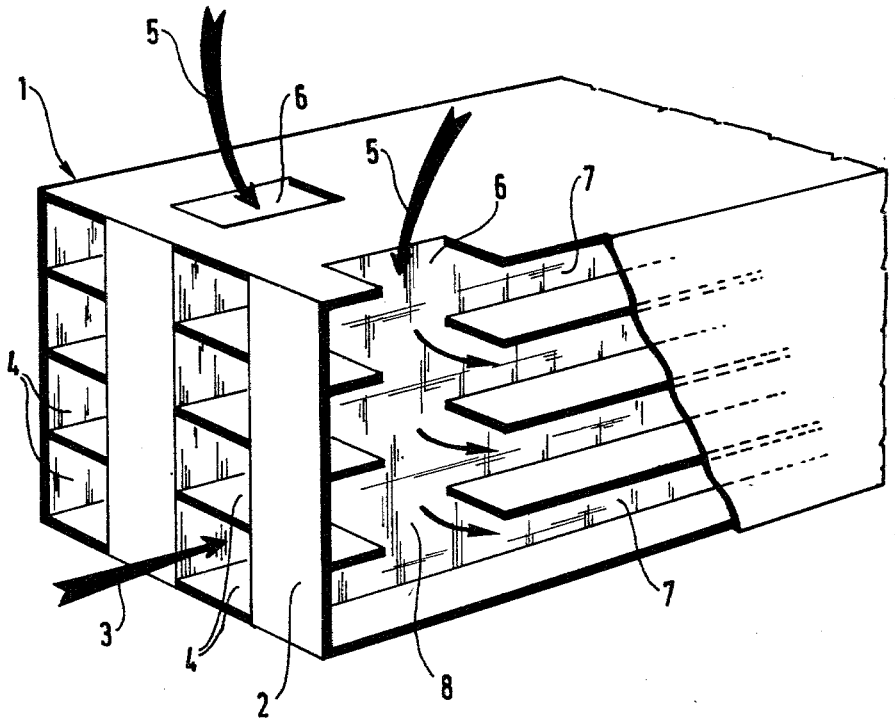
FIG.1 PRIOR ART
FIG. 1 is a partial cut-away perspective view of a type of cellular structure of rectangular cross-section, in accordance with the prior art.

In FIG. 1, an end of a cellular structure 1 in accordance with the prior art is of a rectangular cross-section and has a rectangular mesh. The end surface 2 is closed selectively in alternating parallel rows: a first flux is brought in (arrow 3) via the end surface 2 in parallel ducts such as 4 and is removed via the other end surface (not shown here), while a second flux is let in (arrow 5) via side orifices 6 in parallel ducts such as 7 (whose ends are therefore closed) and discharged laterally in the neighbourhood of the other end surface. Heat exchange takes place through walls such as 8 which separate two adjacent sets of ducts. Such a structure is formed by extrusion followed by drying and heat treatment when it is made of a ceramic material and its end surfaces are generally selectively closed up by immersion in slip.

It will be perfectly understood that besides production difficulties when dimensions are small, there are difficulties with the ridges (twelve in all) both during treatment, which is necessarily non-homogeneous, and for mechanical rigidity of the structure.

In contrast, the invention provides quite a different design whose fundamental principle resides in the fact that the general organisation of said structure is essentially cylindrical, that the ducts are defined by radial type walls and circular type walls and that said ducts define assemblies with essentially radiating dispositions through the same flux passes. The structure therefore makes it possible to use a circular cross-section and in particular the circulation of two fluxes inside said structure make optimum aerodynamic use of the cross-section, it being understood that applications may very well be found in which only one flux is used, as specified hereinafter.

Figure 2:
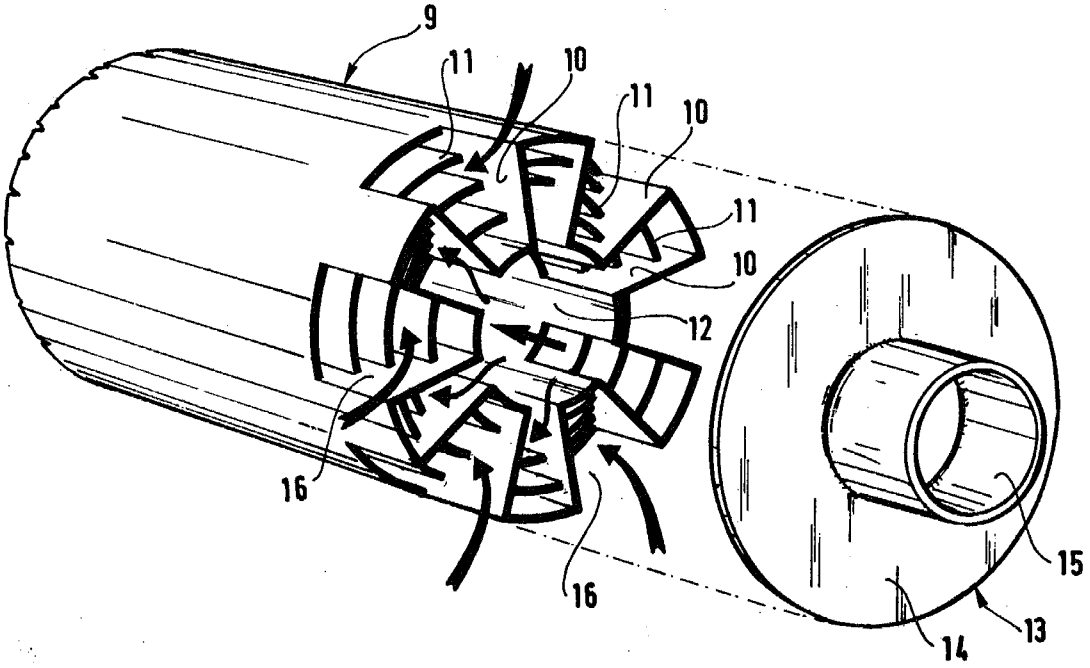
FIG. 2 is a partial perspective view of a cellular structure in accordance with the invention, which structure is designed to have two distinct fluxes flowing through it, one of which is brought in via a central duct.

FIG. 2 illustrates one embodiment of a structure 9 in accordance with the invention, in which structure the ducts are defined by radial or circumferential walls 10 and circular or circumferential walls 11, said ducts defining assemblies which are disposed in an essentially radiating configuration and through which the same flux passes. Here, the figure illustrates clearly the generally cylindrical organization as far as concerns not only the layout of the ducts through which the same flux passes, said layout being an essentially radiating one which alternates according to angular position, but also the cross-section, the cylindrical outer surface allowing drying and heat treatment which are much more even and providing very much greater mechanical rigidity relative to structures of rectangular cross-section.

In accordance with a particularly advantageous disposition, the structure 9 is made in the form of a hollow cylinder whose annular cross-section forms the useful cellular portion and is constituted by sets of parallel ducts and whose central passage 12 is a duct through which one of the two inlet and/or outlet fluxes can pass, said duct being closed in the neighbourhood of one of its ends (not shown here, but illustrated subsequently in FIGS. 4 and 5 which show cross-sections thereof) to distribute the flux in the cells of said structure. At each end, the structure includes an end piece 13 whose circular surface 14 can be used to close simultaneously all the ducts which lead out at the annular end surface while allowing free access to the central duct 12 via an orifice 15. Said end piece may be made of any sealing substance (metal or ceramic) and, as required, is fixed either by metal coating the ceramic substance at high temperature or by bonding or by brazing with glassy substances, depending on the operating temperature ranges.

It is necessary to emphasize how such a central duct is used, its communication with a set of ducts not being always necessary, since said central duct is used in quite a remarkable way: indeed, up till now, central ducts have been used only as passages for wheel hubs in the case of cellular wheels made of a ceramic substance where said wheels form rotary heat exchangers, e.g. regenerators. Now, here, the function of the duct is infinitely more active, since it allows one of the fluxes to flow in and flow out, there being the appreciable advantage of possible complete closing of the end surfaces instead of selective closing of the ducts of one of the two groups, as was the case for a structure of the type illustrated in FIG. 1, said selective closing being a tricky and expensive operation. Further, the annular configuration, whether the central passage does or does not serve to convey a flux, reduces stresses due to dimensional variations of the structure while it is being manufactured and/or used.

Therefore, in FIG. 2, one set of ducts communicates with the central duct and the end piece closes said ducts simultaneously, while the other set of ducts associated with the second flux has lateral orifices 16 for letting the associated flux flow in and/or out.

Figure 3A:
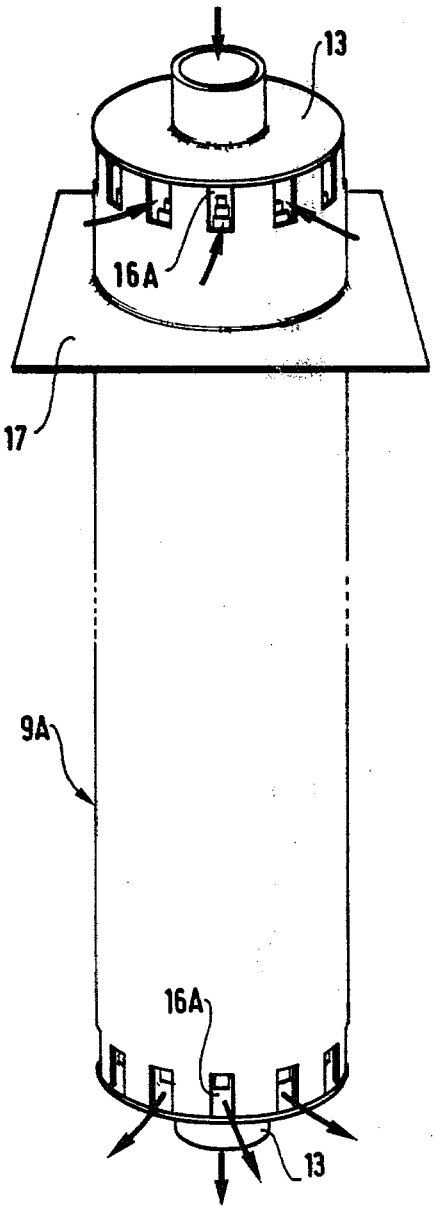
FIGS. 3A and 3B are perspective views which illustrate a complete cartridge whose lateral orifices are respectively at the ends or set back relative to the annular surface of each end.
Figure 3B:
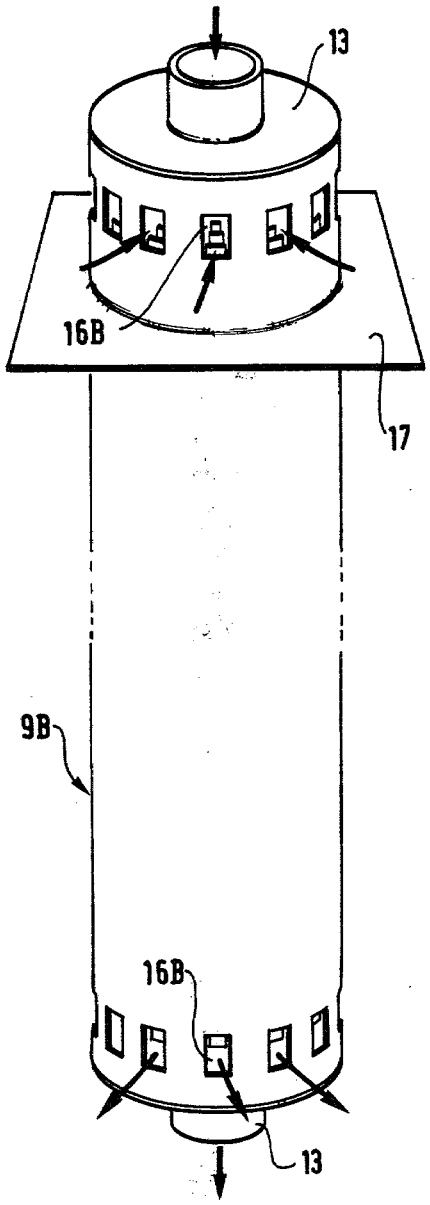

FIGS. 3A and 3B illustrate complete structures in the form of cartridges each with a separation wall 17 fixed on the outer surface to separate the two fluxes. One of said cartridges has lateral input and output orifices 16A for one of the fluxes opening out directly against the planes of its annular end surfaces while the other cartridge has similar orifices 16B provided at some distance from its end surfaces, in which case machining is somewhat complicated but the rigidity of the ends of the structure is appreciably increased. The orifices are generally formed by conventionally machining the partitions by means of grindstones, milling tools or any other method (ultrasonics, lasers, etc.) preferentially, machining is performed on the raw ceramic unit when extruded, while for a pre-baked unit (biscuit) or, even, for a baked unit, it is preferable to use ultrasonics or diamond disks. In any case, the structure with its orifices can be baked to give it the required mechanical strength.

Figure 4:
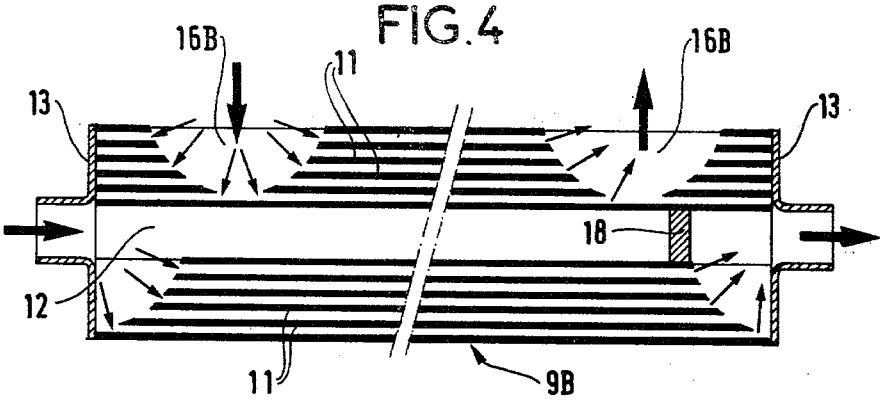
FIG. 4 is a schematic cross-section of the structure illustrated in FIG. 3B, illustrating the paths followed by the two fluxes.

FIG. 4 effectively illustrates the paths along which the two fluxes pass through structure 9B and shows a sealed plug 18 which closes the central duct 12: the lower portion of the cross-section relates to the circulation of the flux brought into the consecutive parallel ducts via the central duct, while the upper portion relates to the circulation of the other flux which is brought in and removed laterally via the orifices 16B. The circular cut out portion of the orifices schematically represents machining of the walls by a circular type of grindstone, but it is self-evident that any shape of cut may be chosen.

Figure 5A:
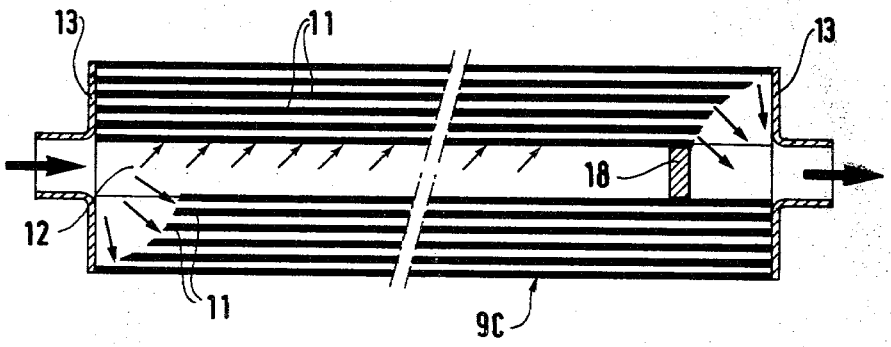
FIGS. 5A and 5B are schematic cross-sections for variants with only one in-coming flux and two outgoing fluxes one of which is a filtered path of the in-coming flux, the structure then constituting a filter, namely, respectively, a total flux filter and a by-pass flux filter, e.g. for filtering gases emitted by diesel engines.
Figure 5B:
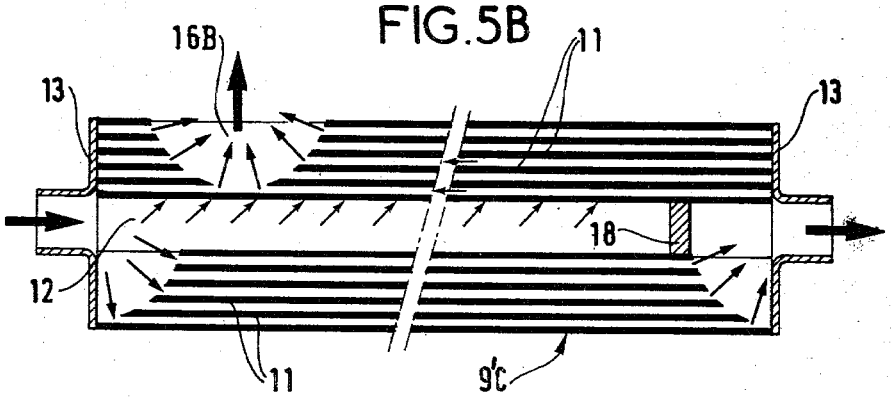

FIGS. 5A and 5B illustrate variants which constitute a filter e.g. for filtering the gas which comes from diesel engines. In accordance with these variants, partitioning between the two groups of ducts is such that the removed flux is a filtered part of the flux brought in by the central duct 12 after crossing said partitioning: naturally, the structure is formed using a material of required porosity as a function of the particular gas to be filtered; the filter shown in FIG. 5A is a total flux filter and in this case, structure 9C has no lateral orifice, while the filter shown in FIG. 5B is a by-pass flux filter and in this case, structure 9'C has a side orifice 16B for the by-pass part of the flux.

Figure 6A:
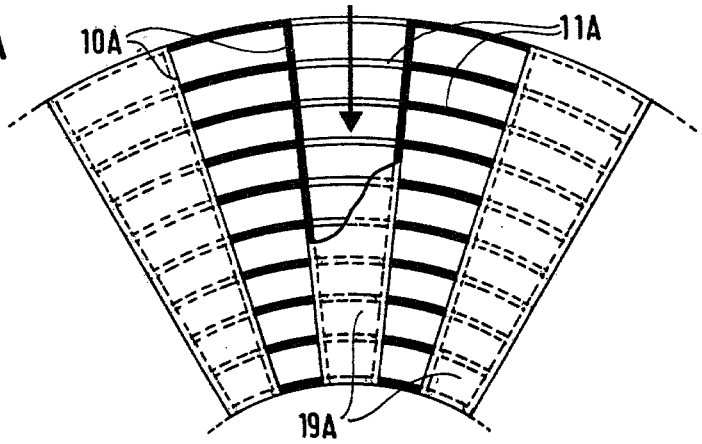
FIGS. 6A, 6B and 6C are partial cut away views which illustrate different variants of the radial type walls and circular type walls.
Figure 6B:
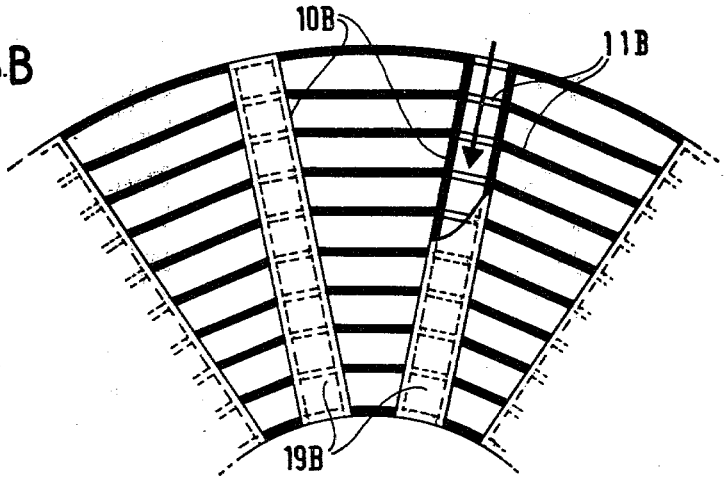
Figure 6C:
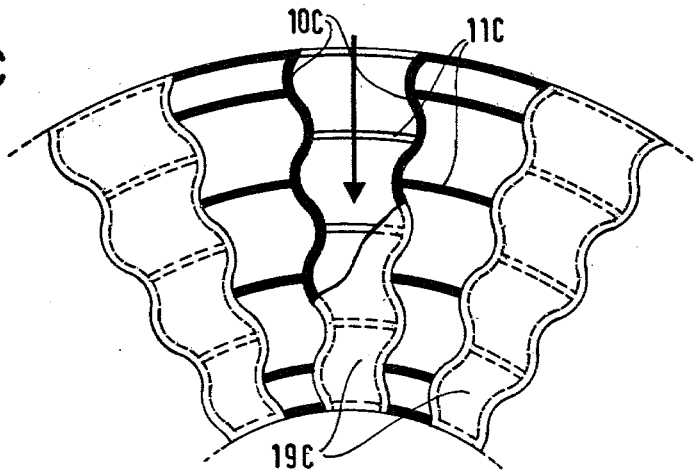

FIGS. 6A to 6C show non-limiting examples of radial type and circular type walls. In FIG. 6A, walls 10A are rectilinear and form radial planes while walls 11A form cylinders which are coaxial to said structure. In FIG. 6B, walls 10B are rectilinear and form planes which are parallel in pairs, while walls 11B are rectilinear between two adjacent walls 10B which define contours illustrated by dashed lines. In FIG. 6C, walls 10C are corrugated, while walls 11C form coaxial cylinders which are staggered between each pair of walls 10C and are connected thereto at the crests of the corrugations.

It has previously been stated that the ducts can be closed simultaneously at the annular end surfaces with an end piece allowing a flux to pass through the central duct. In some cases, it may be an advantage to bring in and remove the flux via the annular surfaces in which case each end annular surface has a selective radial closing means e.g. a set of radiating annular sectors which are shown in cut-away views in FIGS. 6A, 6B and 6C and are referenced 19A, 19B and 19C respectively therein. If these sectors are sufficiently large, as shown in FIG. 7, advantage can be taken of these large portions to increase the useful interflux area: for this purpose, their large zone can be provided with a portion 20 which is not cut away and opens into other ducts through which the flux is brought in and removed via the annular end surfaces; here, walls 10D are rectilinear, parallel in their portions which are not cut away and radial in their other portions, while walls 11D are circular. As shown in FIG. 8, at each end, an end piece 21 can be provided and its circular rim 22 presses against the periphery of each annular end surface or, more precisely, of each sector 19D, the surface of the end piece 21 defining an inner chamber which leads out via a narrower orifice 23.

FIG. 9 illustrates yet another example in which walls 10E and 11E define, for each duct, a cell of almost square cross-section.

It is self evident that the relative spacing between the various walls must be perfectly suited to the stresses due to the effect of the differential pressure of the two fluxes. The radial type walls are disposed so as to distribute the area made available to each of the two flows in accordance with the required aerodynamic criteria: in particular, the spacing between said walls is chosen as a function of the discharges and of the speeds of each of the fluxes.

Finally, it must be observed that the structure in accordance with the invention provides two extra advantages: firstly, due to the rigidity of its shape, the annular design makes it possible to produce longer cartridges than with any other form of structure of given useful cross-section; secondly, the cylindrical cross-section incidentally allows the structure to rotate about its axis during the manufacturing stages. This greatly assists homogenous drying.

I claim:

1. A static, cylindrical monolithic, heat exchange structure having a large area of contact, said structure comprising circumferentially spaced radial walls and radially spaced circular walls intersecting said radial walls and forming at least two radial groups of ducts with each group conveying a fluid flow particular to the group with at least some of the radial walls constituting group boundaries, and wherein the circular walls of the parallel ducts forming at least one of said groups is cut out at at least one location along their length to facilitate fluid flow into or out of the parallel ducts of said group.

2. A structure according to claim 1, having the shape of a hollow cylinder whose annular cross-section is constituted by sets of parallel ducts forming said at least two groups, and said structure further comprising a central duct forming a central passage for bringing in and/or removing a flux, said central duct being closed in the neighbourhood of one of its ends by a sealing plug, and wherein said circular walls forming said parallel ducts of said at least one group are cut out so as to open to said central duct.

3. A structure according to claim 2, having an end piece at each end of said cylinder, said end pieces being sized and configured to close selected annular end surfaces of said ducts while allowing free access to the central duct.

4. A structure according to claim 3, wherein said one group of ducts communicates with the central duct, the end pieces simultaneously closing said ducts of said group, and wherein the other group of ducts have lateral inlet and outlet orifices for the associated flux, and wherein the circular walls are cut out in radially stepped fashion to form lateral inlet and outlet orifices for the associated flux.

5. A structure according to claim 4, wherein the lateral orifices open directly against the planes of the end piece annular end surfaces.

6. A structure according to claim 4, wherein the lateral orifices are set at a distance from the end piece annular end surfaces with a view to providing greater rigidity.

7. A structure according to claim 4, wherein the partitioning between the two groups of ducts is porous such that the flux removed through the associated lateral orifices is a filtered part of the flux brought in via the central duct after passing through said partitioning.

8. A structure according to claim 2, wherein each end plate annular end surface has a selective radial closing means so that one of the two fluxes is brought in and removed via said annular surfaces, while the group of ducts associated with the other flux has lateral inlet and outlet orifices for said flux.

9. A structure according to claim 8, wherein selective closing is provided by a set of radiating annular sectors.

10. A structure according to claim 9, wherein each of the annular sectors has a portion at its large end which is not cut out and which opens into other ducts bearing the flux brought in and removed via the annular end surfaces.

11. A structure according to claim 8, having an end duct piece at each end, each of said end duct pieces having a circular rim which presses against the periphery of the adjacent annular end surface and whose surface defines an inner chamber which opens towards the outside via a narrower orifice.

12. A structure according to claim 1, wherein the radial walls of the parallel ducts are rectilinear.

13. A structure according to claim 12, wherein the radial walls form radial planes.

14. A structure according to claim 12, wherein the radial walls form planes which are parallel in pairs.

15. A structure according to claim 1, wherein the circular walls of the parallel ducts form cylinders which are coaxial with said structure.

16. A structure according to claim 1, wherein the circular walls of the parallel ducts are rectilinear between two adjacent radial walls and define contours illustrated by dashed lines.

17. A structure according to claim 1, wherein the radial walls of the parallel ducts are corrugated.

18. A structure according to claim 17, wherein the circular walls are disposed in a configuration which is staggered between each pair of radial type walls.

19. A structure according to claim 15, wherein the circular walls are joined to corrugated radial walls at the crests of the radial wall corrugations.

* * * * *